United States Patent [19]

Lee et al.

[11] Patent Number: 4,910,075

[45] Date of Patent: Mar. 20, 1990

[54] POINT-BONDED JET-SOFTENED POLYETHYLENE FILM-FIBRIL SHEET

[75] Inventors: Chi-Chang Lee, Richmond, Va.; Penny C. Simpson, Derwood, Md.

[73] Assignee: E. I. Du Pont de Nemours and Company, Wilmington, Del.

[21] Appl. No.: 259,224

[22] Filed: Oct. 18, 1988

[51] Int. Cl.[4] ..... D03D 3/00

[52] U.S. Cl. ..... 428/224; 156/167; 428/170; 428/195; 428/221

[58] Field of Search ..... 156/167; 28/104; 428/170, 195, 221, 224

[56] References Cited

U.S. PATENT DOCUMENTS

| | | | |
|---|---|---|---|
| 3,169,899 | 2/1965 | Steuber | 161/72 |
| 3,403,862 | 10/1968 | Dworjanyn | 239/566 |
| 3,442,740 | 5/1969 | David | 156/181 |
| 3,478,141 | 11/1969 | Dempsey et al. | 264/284 |
| 4,152,389 | 5/1979 | Miller | 264/284 |
| 4,329,763 | 5/1982 | Alexander et al. | 28/104 |

*Primary Examiner*—James J. Bell

"Protective Apparel of Du Pont Tyvek"—"Safety you can wear," E-02145 (1987).

Research Disclosure, 21126, "Tyvek" softening process—(1 November 1981)

[57] ABSTRACT

Point-bonding and water-jet-softening of a sheet of flash-spun polyethylene plexifilamentary film-fibril strands provide a nonwoven fabric that is particularly suited for use in disposable protective garments. Garments made with the nonwoven fabric are comfortable and provide a good protection against particulate matter, such as air-borne asbestos particles.

7 Claims, No Drawings

POINT-BONDED JET-SOFTENED POLYETHYLENE FILM-FIBRIL SHEET

BACKGROUND OF THE INVENTION

1. Field of the Invention

This invention relates to a point-bonded, hydraulically jet-softened, nonwoven sheet of polyethylene film-fibril plexifilamentary strands intended for use in disposable industrial garments. More particularly, the invention concerns such a sheet that is point-bonded in such a specific way that jet-softening results in a product that is especially suited for providing comfort to the user while being a strong barrier to asbestos particles.

2. Description of the Prior Art

Spunbonded sheets of flash-spun polyethylene plexifilamentary film-fibril strands have been used in disposable industrial garments. Such sheets have been made commercially by E. I. du Pont de Nemours and Company and sold as "Tyvek" spunbonded olefin. The sheets are known for their good strength, durability, opacity and ability to act as a barrier to particulate matter as small as sub-micron size. Because of these desirable characteristics, the spunbonded sheets have been fashioned into many types of industrial garments, such as those worn by asbestos workers, as disclosed in "Protective Apparel of Du Pont TYVEK-®—SAFETY YOU CAN WEAR", E-02145, (1987). However, the utility of the garments could be greatly enhanced by improvements in the spunbonded sheet from which the garment is made in order to provide a softer and more breathable garment that is more comfortable to the wearer.

Various methods have been disclosed for bonding polyethylene film-fibril sheets. For example, sheets of lightly consolidated flash-spun polyethylene film-fibril strands of the type disclosed by Steuber, U.S. Pat. No. 3,169,899 have been bonded (a) over the entire surface of the sheet, as disclosed by David, U.S. Pat. No. 3,442,740, (b) over 3 to 25% of the surface area of the sheet by passage through a loaded nip formed by a heated metal roll having 50 to 1000 hard bosses per square inch which extend from the surface of the roll to a height of at least 1.2 times the thickness of the sheet and a hard back-up roll having a Shore Durometer D hardness of at least 70, as disclosed by Miller, U.S. Pat. No. 4,152,389 and (c) over 1 to 5% of the area of the sheet by passage of the sheet through in a loaded nip formed by a heated, embossed metal roll having bosses and a soft back-up roll of a 60 to 90 Shore Durometer B hardness, as disclosed by Dempsey and Lee, U.S. Pat. No. 3,478,141. Each of the resultant bonded sheets still need improvement, especially in softness, if they are to be used for industrial garments.

Various methods have been suggested for softening bonded polyethylene film-fibril sheets. These include softening the bonded sheet by flexing the sheet under water as in a washing machine, passing the sheet over a series of rollers that have bosses that stroke the sheet, passing the sheet over a "knife edge" and the like. The use of water jets to treat point-bonded non-woven sheets has been suggested by Alexander and Baugh, U.S. Pat. No. 4,329,763. *Research Disclosure,* 21126, "Tyvek® softening process" (November 1981) discloses that point-bonded sheet of the type disclosed by Miller, has been softened with high energy water jets of the type disclosed by Dworjanyn, U.S. Pat. No. 3,403,862. However, improvements are still needed in such softened sheets, particularly in delamination resistance and surface durability. For example, commercially available Type 1422A "Tyvek", which has a "linen by rib" bonding pattern embossed upon it by the general method of Miller, when softened with jets of water, shows a tendency to delaminate quite readily. A sheet having its total surface bonded by the method of David, when water-jet treated has a tendency to trap water, causing large areas of delamination of the sheet.

In addition to the delamination problems associated with the water-jet-treated point-bonded sheets mentioned above, the sheets exhibit an undesirable Moiré effect, when identical point-bonding patterns are employed on both sides of the sheet. The Moiré problem is avoided in some point-bonded nonwovens by embossing (i.e., point-bonding) only from one side, but such sheets suffer from poor abrasion resistance and too much lint formation on at least one side.

An object of the present invention is to provide a spunbonded flash-spun polyethylene film-fibril sheet that is particularly suited for use in disposable protective garments and that would greatly alleviate the shortcomings of the above-described known sheets.

SUMMARY OF THE INVENTION

The present invention provides a process for preparing a nonwoven fabric that is particularly suited for use in disposable protective garments of the type worn by workers handling asbestos. The process comprises passing a lightly consolidated, flash-spun polyethylene plexifilamentary film-fibril sheet having a unit weight in the range of 25 to 50 grams per square meter through two successive nips, each nip being formed between two rolls, one of which is a heated metal roll having hard bosses on its surface and the other roll having a resilient surface the Shore A durometer hardness of which is in the range of 60 to 70, the heated metal roll of the first nip contacting one surface of the sheet and the heated metal roll of the second nip contacting the other surface of the sheet, the bosses of the heated metal rolls forming a repeating pattern of regular polygons in which the bosses are spaced in the range of from 4.8 to 7.1 bosses per centimeter and number in the range of 29 to 62 bosses per square centimeter, the bosses having a height that is in the range of 1.4 to 1.8 times the thickness of the sheet being contacted and having a total cross-sectional area at their tips equal to about 4 to 7 percent of the sheet area being treated, the bosses of the second nip being out of register with the bosses of the first nip, each nip applying a load in the range of 9 to 18 kilograms per centimeter of width to the sheet, to form a point-bonded sheet that is then subjected to high energy jets of water supplied from multiple closely spaced orifices having diameters in the range of 0.13 to 0.18 mm to provide the sheet with an energy-impact product in the range of 0.4 to 0.8 megaJoule-Newtons per kilogram. In a preferred embodiment of the invention, the bosses form a repeating rectangular pattern in which the long side of the rectangle is in the range of 1.13 to 1.50 times the length of the shorter side and the long side of the repeating rectangle of the second nip is at about a 90 degree angle to the long side of the repeating rectangle of the first nip. In another preferred embodiment, a hydrophilic finish is applied to the sheet, the finish when dry amounting to 0.2 to 2 percent by weight of the sheet.

The present invention also includes the novel point-bonded sheet which is the sheet that is fed to the water-jet softening step as well as the flash-spun, point-bonded and water-jet softened sheet that results from the process of the invention.

DETAILED DESCRIPTION OF PREFERRED EMBODIMENTS

The starting material for the process of the present invention is a lightly consolidated flash-spun polyethylene plexifilamentary film-fibril sheet produced by the general procedure of Steuber, U.S. Pat. No. 3,169,899. According to a preferred method for making the starting sheets, a linear polyethylene having a density of 0.96 g/cm$^3$, a melt index of 0.9 (determined by ASTM method D-1238-57T, condition E) and a 135° C. upper limit of its melting temperature range is flash spun from a 12 weight percent solution of the polyethylenein trichlorofluoromethane. The solution is continuously pumped to spinneret assemblies at a temperature of about 179° C. and a pressure above about 85 atmospheres. The solution is passed in each spinneret assembly through a first orifice to a pressure let-down zone and then through a second orifice into the surrounding atmosphere. The resulting film fibril strand is spread and oscillated by means of a shaped rotating baffle, is electrostatically charged and then is deposited on a moving belt. The spinnerets are spaced to provide overlapping, intersecting deposits on the belt to form a wide batt. The batt is then lightly consolidated by passage through a nip that applies a load of about 1.8 kilograms per cm of batt width. Generally, thusly formed lightly consolidated sheet having a unit weight in the range of 25 to 50 grams per square meter is suitable for use in the process of the present invention.

The point-bonding of the lightly consolidated sheet is conveniently carried out in two stages. First, one face of the sheet is embossed and then the other face is embossed. This can be accomplished in a continuous process wherein the sheet is passed through two successive nips. Each nip is formed by a pair of coacting rolls; one being a heated metal embossing roll and the other being a resilient backup roll. In each nip a load of 9 to 18 kilograms per centimeter of sheet width is imposed on the sheet.

The resilient roll of each nip generally is an elastomer-covered roll which has a Shore A durometer hardness in the range of 60 to 70.

The embossing roll in each nip usually is internally heated, as for example by steam or oil. The embossing roll has numerous hard bosses on its surface, usually amounting to 29 to 62 bosses per square centimeter. Each boss has a height that is about 1.4 to 1.8 times the thickness of the lightly consolidated sheet. Usually, each boss is approximately circular in cross-section and tapered at an angle of 10 to 20 degrees, most preferably about 15 degrees, toward its tip. The total cross-sectional area of the tips of the bosses amounts to 4 to 7 percent, preferably 5 to 6 percent, of the area of the sheet surface being embossed.

The bosses of each embossing roll are arranged at a spacing in the range of 4.8 to 7.1 bosses per centimeter. The bosses form a pattern of repeating regular polygons. Any regular polygon is suitable. However, to avoid undesired Moiré effects in the final sheets, the pattern of bosses on the embossing roll of the first nip should be different from the pattern on the embossing roll of the second nip. A preferred pattern of bosses forms a repeating rectangular pattern in which the long side of each rectangle is in the range of 1.13 to 1.50 times the length of the short side and the long sides of the repeating rectangles of the first nip are arranged perpendicular to the long side of the repeating rectangles of the second nip. The rolls of the nips are arranged so that one surface of the lightly consolidated sheet is contacted by the bosses of the embossing roll of the first nip and the other surface of the sheet is contacted by the bosses of the embossing roll of the second nip.

The temperature of the embossing roll is adjusted, depending on the weight of the sheet being treated and the speed at which it passes through the gap. The temperature is sufficient to cause translucent point bonds to be formed in the sheet but not so high as to cause excessive melting and perforating of the sheet.

After the flash-spun polyethylene plexifilamentary film-fibril sheet has been point-bonded as described above, the sheet is subjected to high energy, high impact jets of water delivered through closely spaced small orifices. The jets impart to the sheet an impact-energy product ("I33 E") in the range of 0.4 to 0.8 megaJoule-Newtons per kilogram. Equipment of the general type disclosed by Evans, U.S. Pat. No. 3,485,706 and by Dworjanyn, U.S. Pat. No. 3,403,862 is suitable for the water-jet treatment.

The energy-impact product delivered by the water jets impinging upon the point-bonded sheet is calculated from the following expressions, in which all units are listed in the "english" units in which the measurements reported herein were originally made so that the E×I product is in horsepower-pounds force perpound mass, which then was converted to megaJoule-Newtons per kilogram by multiplying the english units by 26.3:

$$I = PA$$

$$E = PQ/wzs,$$

wherein

I is impact in lbs force
E is jet energy in horsepower-hours per pound mass
P is water supply pressure in pounds per square inch
A is cross-sectional area of jet in square inches
Q is volumetric water flow in cubic inches per minute
w is sheet unit weight in ounces per square yard
z is sheet width in yards and
s is sheet speed in yards per minute.

Although impact energy products (E×I) in the range of 0.015 to 0.030 horsepower-hour pound force per pound mass (i.e., 0.4 to 0.8 megaJoules-Newtons per kilogram) of sheet are generally suitable for use in making sheets intended for use in protective garments, higher energy-impact products can sometimes be employed. Increases in the energy-impact of the water-jet treatment increase the softness and Frazier air permeability of the sheet. However, excessively high energy-impact can cause holes to be formed in the sheet of sufficient size to be visible to the unaided eye. Such holes obviously have a strong adverse effect on the ability of the sheet to holdout particulate matter or liquids.

The desired energy impact products can be achieved by operating with the water-jet treatment step under the following typical conditions. Sheet can be treated from one or both sides of the sheet by closely spaced jets of small diameter. Jets can be located between 2 to 7.5 cm above the sheet being treated and arranged in rows perpendicular to the movement of the sheet. Each row can contain between 4 and 25 jets per centimeter. Orifice diameters in the range of about 0.12 to 0.18 mm are suitable. The orifices can be supplied with water at a pressure in the range of 2,000 to 20,000 kPa. Generally the sheet is supported on a screen. A fairly broad range of screen mesh sizes is suitable, as for example, from about 40 mesh to about 100 mesh (mesh is equivalent to the number of openings in the screen per square inch or per 6.45 $cm^2$). Depending on the sheet speed, the other parameters are adjusted to provide the energy impact product needed in accordance with the invention to provide the desired degree of softening for the point-bonded sheet.

As a result of the water-jet treatment of the point-bonded sheets in accordance with the invention, annular "puffed up" areas are formed immediately surrounding each of the 29 to 62 point bonds per square centimeter. The transluscent point bonds still occupy about 4 to 7 percent of the sheet area. The annular puffed up area amounts to about 30 to 50 percent of the total area of the sheet. Puffed up areas of 35 to 45 percent are preferred. It is believed that these puffed up areas lead to the much greater comfort experienced by wearers of garments made from the nonwoven fabrics of the invention. The sheet generally has a delamination resistance in the range of 0.1 to 0.3 Newtons/cm and a Frazier porosity in the range of 100 to 400 cm/minute.

If desired, an additional improvement in wearer comfort of garments made from sheets of the invention, can be achieved if the point-bonded and water-jet-treated sheet of the invention have a hydrophilic finish applied to the sheet. When such an optional finish is used, the dry weight of the finish adds 0.2 to 2 percent to the weight of the sheet.

The following test procedures were employed to determine the various reported characteristics and properties reported herein. ASTM refers to the American Society of Testing Materials.

Sheet unit weight is measured in accordance with ASTM D 646-50. Delamination resistance is determined as described in Dempsey and Lee, U.S. Pat. No. 3,478,141, column 4, line 75, through column 5, line 15, the description of which is hereby incorporated herein by reference. Frazier porosity is determined by ASTM D 737-75 and hydrostatic head is determined by ASTM D-538-63. Shore A Durometer hardness is determined with an instrument manufactured by Shore Instrument Manufacturing Co. of Jamaica, N.Y., by the methods described in ASTM D-1706-61 and D-1484-59.

The ability of the point-bonded and water-jet softened sheets of the invention to be a barrier to asbestos fibers is demonstrated with an apparatus in which air-streams containing Quebec Grade 7R chrysolite asbestos fibers (a commercial grade of asbestos known to contain the highest fraction of short fibers) were passed at a velocity of 1.35 cm/sec through sample sheets that were backed by "absolute" membrane filters. The number and size distribution of the fibers collected on the absolute filters were determined by optical and electron microscopy and a "hold-out efficiency" was calculated therefrom for the sample sheet. Sheets of the invention generally provided a hold-out efficiency of at least 85%.

The degree of comfort provided to a wearer of a disposable protective garment made with nonwoven fabric of the invention was determined subjectively. In wear tests conducted at 25° C. and 79% relative humidity, testers rated the comfort of the garment based on perspiration level, heat retention, absorbancy, softness and general aesthetics. A scale of 0 to 5 was established. "Tyvek" Type 1422A, a commercially available, point-bonded, polyethylene plexifilamentary film-fibril sheet, used widely for disposable protective garments, was assigned a value of 0 to indicate that the garment becomes quite uncomfortable after a couple of hours of use. A rating of 5 was established to indicate about the same degree of comfort afforded by typical polyester work clothing. A rating of 3 indicated that the test garment is considerably more comfortable than the "Tyvek" 1422A but not as comfortable as polyester work clothing.

The invention is further illustrated by the following example of a preferred embodiment of the invention. The results reported are believed to be representative but do not constitute all the runs involving the indicated materials. This example is included for the purposes of illustration and is not intended to limit the scope of the invention, which is defined by the appended claims.

EXAMPLE

A lightly consolidated sheet of flash-spun polyethylene plexifilamentary film-fibril strands weighing 40.7 $g/m^2$ was prepared as described above by the general method of Steuber, U.S. Pat. No. 3,169,899.

The lightly consolidated sheet was point-bonded by passage through two 86.4-cm-wide heated nips. The first nip was formed by a heated metal roll and a resilient rubber covered roll. The metal roll had a repeating rectangular pattern of bosses. Each boss measured about 0.30 mm in height and about 0.46 mm in tip diameter. The pattern included 16 bosses per inch (6.3/cm) in the machine direction and 12 bosses per inch (4.7/cm) in the cross-machine direction, to give a total of 192 bosses per square inch (29.7/$cm^2$) on the roll. The top of the sheet was in contact with the bosses of the first nip.

The second nip was constructed and operated identically to the first nip except that (a) the bosses were arranged 4.7/cm in the machine direction and 6.3/cm in the cross-machine direction and (b) the bottom of the sheet came in contact with the metal bosses of the second nip.

In each nip, the sheet speed was 30.5 meters per minute, the metal roll was internally heated by steam at 155° C., and a load of 15 kg/cm of nip width was imposed upon the sheet. As a result of the embossing treatment, the sheet had about 5% of each of its surfaces bonded.

The thusly point-bonded, flash-spun polyethylene plexifilamentary film-fibril sheet was then subjected to a water-jet treatment in accordance with the invention. The sheet, while supported on a 40 mesh screen, was passed at about 23 meters per minute under a series of five headers each of which contained a line of orifices from which water jetted onto the sheet with high energy and high impact. The jets were located 2.5 cm above the surface of the sheet. Two passes were made with the jets impinging on the top face of the sheet and two passes were made with the jets impinging on the bottom face of the sheet. The total energy-impact product ($E \times I$) imparted to each side by the water-jet treatment was 0.53 megaJoule-Newtons per kilogram (0.020 horsepower-hour pound force per pound mass). The following table summarizes the construction of the headers and the pressure of the water supplied to the jets.

TABLE

| Header | Water-Jet Treatment of Sheet 1 and 2 | 3 and 4 | 5 |
|---|---|---|---|
| Supply pressure | | | |
| kPa | 3,445 | 4,134 | 6,890 |
| (psi) | (500) | (600) | (1,000) |
| Number of orifices | | | |
| per cm | 23.6 | 15.7 | 27.6 |
| (per inch) | (60) | (40) | (70) |
| Orifice diameter | | | |
| mm | 0.13 | 0.13 | 0.18 |
| (inch) | (0.005) | (0.005) | (0.007) |

After drying, the water-jet treated product had a delamination resistance of 0.14 Newtons per centimeter (0.08 pound per inch), a Frazier porosity of about 3 meters per minute (9.7 ft/min), a hydrostatic head of about 20 centimeters and a comfort rating of 4.3. The asbestos fiber hold-out efficiency was close to 90%.

A hydrophilic finish was applied to the sheet by dipping the sheet in a 50° C. aqueous bath containing a 2 percent solution of a 4 to 1 mixture of "Merpol" A ethoxylated phosphate and "Duponol" C sodium lauryl sulfate. The sheet was then dried. The dry finish amounted to 2 percent by weight of the sheet. As a result of the finish application the hydrostatic head was reduced but the wear-test comfort rating increased to 5.

These and other similar results demonstrated that point-bonded and water-jet softened sheets of flash-spun polyethylene plexifilamentary film-fibril strands, prepared and treated in accordance with the present invention, provide a superior nonwoven fabric for use in disposable protective garments.

We claim:

1. A process for preparing a nonwoven fabric that is particularly useful in a disposable protective garment of the type worn by asbestos workers comprising passing a lightly consolidated, flash-spun polyethylene plexifilamentary film-fibril sheet having a unit weight in the range of 25 to 50 grams per square meter through two successive nips, each nip being formed between two rolls, one of which is a heated metal roll having hard bosses on its surface and the other roll having a resilient surface the Shore A durometer hardness of which is in the range of 60 to 70, the heated metal roll of the first nip contacting one surface of the sheet and the heated roll of the second nip contacting the other surface of the sheet, the bosses of the heated metal rolls forming a repeating regular polygon pattern in which the bosses are spaced in the range of from 4.8 to 7.1 bosses per centimeter and number in the range of 29 to 62 bosses per square centimeter, the bosses having a height that is in the range of 1.4 to 1.8 times the thickness of the sheet being contacted and having a total cross-sectional area at their tips equal to about 4 to 7 percent of the sheet area being treated, the bosses of the second nip being out of register with the bosses of the first nip, each nip applying a load in the range of 9 to 0.18 kilograms per centimeter of width to the sheet, to form a point-bonded sheet that is then subjected to high energy jets of water supplied from multiple closely spaced orifices having diameters in the range of 0.12 to 0.18 mm to impart to the sheet an energy-impact product in the range of 0.4 to 0.8 megaJoule-Newtons per kilogram.

2. A process in accordance with claim 1 wherein the bosses form a repeating rectangular pattern in which the long side of the rectangle is in the range of 1.13 to 1.50 times the length of the shorter side and the long side of the repeating rectangle of the second nip is at about a 90 degree angle to the long side of the repeating rectangle of the first nip.

3. A process in accordance with claim 1 or 2 wherein the bosses contact 5 to 6 percent of the area of the sheet surface.

4. A process in accordance with claim 1 wherein a hydrophilic finish is applied to the water-jet-treated sheet, the dry weight of the finish amounting to 0.2 to 2 weight percent of the sheet.

5. A point-bonded flash-spun polyethylene plexifilamentary film-fibril intermediate sheet produced by the point-bonding steps of the process of claim 1 or 2 in which the point bonds are transluscent and amount to 4 to 7 percent of the surface area of the sheet.

6. A point-bonded and softened flash-spun polyethylene plexifilamentary film-fibril sheet of the process of claim 1, 2 or 4 having 29 to 60 translucent point bonds per square centimeter amounting to 4 to 7 percent of the sheet surface and puffed-up annular areas around the point bonds amounting to between 30 and 50 percent of the total surface area of the sheet.

7. A sheet of claim 6 having a delamination resistance in the range of 0.1 to 0.3 Newtons per centimeter, a Frazier porosity in the range of least 100 to 300 cm/min and a comfort rating of at least 3.5.

* * * * *